US007295799B2

(12) United States Patent
Marsh et al.

(10) Patent No.: US 7,295,799 B2
(45) Date of Patent: Nov. 13, 2007

(54) SYNCHRONOUS DUPLEX PRINTING SYSTEMS USING PULSED DC FIELDS

(75) Inventors: Dana G. Marsh, Newark, NY (US); George R. Walgrove, III, Rochester, NY (US); Michael W. Frauens, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 288 days.

(21) Appl. No.: 11/089,498

(22) Filed: Mar. 24, 2005

(65) Prior Publication Data

US 2005/0214040 A1 Sep. 29, 2005

Related U.S. Application Data

(60) Provisional application No. 60/557,513, filed on Mar. 29, 2004.

(51) Int. Cl.
*G03G 15/20* (2006.01)
*G03G 15/16* (2006.01)

(52) U.S. Cl. ..... 399/309; 399/66; 399/306

(58) Field of Classification Search ..... 399/66, 399/297, 299, 306, 308, 309, 313, 314
See application file for complete search history.

(56) References Cited

U.S. PATENT DOCUMENTS 4,191,465 A 3/1980 Boase et al.
4,212,529 A 7/1980 O'Brien et al.
4,214,831 A 7/1980 Reesen
4,447,176 A 5/1984 Blough et al.
4,473,029 A 9/1984 Fritz et al.
4,546,060 A 10/1985 Miskinis et al.
5,070,369 A 12/1991 Mahoney et al.
5,070,371 A 12/1991 Randall
5,070,372 A 12/1991 Randall
5,799,226 A 8/1998 Shigeta et al.
5,799,236 A 8/1998 Paczkowski
5,826,143 A 10/1998 Haneda et al.
5,899,611 A 5/1999 Haneda et al.
5,905,931 A 5/1999 Shigeta et al.
5,930,572 A 7/1999 Haneda et al.
5,970,277 A 10/1999 Shigeta et al.
5,991,563 A 11/1999 Haneda et al.
6,038,410 A 3/2000 Iriyama
6,556,804 B1 * 4/2003 Lobel et al. ..... 399/306

FOREIGN PATENT DOCUMENTS

JP 03132684 * 6/1991

OTHER PUBLICATIONS

U.S. Appl. No. 60/551,464, "Powder Coating Apparatus and Method of Powder Coating Using an Electromagnetic Brush," filed Mar. 9, 2004, Stelter, et al.

* cited by examiner

*Primary Examiner*—Hoang Ngo
(74) *Attorney, Agent, or Firm*—Donna P. Suchy

(57) ABSTRACT

An imaging system may use pulsed dc voltages to synchronously image on both sides of a receiver material, such as during a single pass of the receiver material through the imaging system. The imaging system may use electrophotographic processes to image on the receiver material. Alternatively, the imaging system may use directed charged particle or aerosol toner development processes to image on the receiver material.

31 Claims, 10 Drawing Sheets

SYNCHRONOUS DUPLEX PRINTING SYSTEMS USING PULSED DC FIELDS

CROSS REFERENCE TO RELATED APPLICATIONS

This is a 111A application of Provisional Application Ser. No. 60/557,513, filed Mar. 29, 2004, entitled SYNCHRONOUS DUPLEX PRINTING SYSTEMS USING PULSED DC FIELDS by Dana G. Marsh, et al.

FIELD OF THE INVENTION

This invention generally relates to electrographic and electrophotographic printers. More specifically, it relates to using pulsed dc fields in order to synchronously transfer images onto both sides of a receiver.

BACKGROUND OF THE INVENTION

Electrographic and electrophotographic processes form images on selected receivers, typically paper, using small dry colored particles called toner. The toner usually comprises a thermoplastic resin binder, dye or pigment colorants, charge control additives, cleaning aids, fuser release additives, and optionally flow control and tribocharging control surface treatment additives. The thermoplastic toner is typically attached to a print receiver by a combination of heating and pressure using a fusing subassembly that partially melts the toner into the fibers at the surface of the receiver.

Typically, in an electrographic or electrophotographic printer or copier (collectively referred to herein as "printers"), a heated fuser roller/pressure roller nip is used to attach and control the toner image to a receiver. Heat can be applied to the fusing rollers by a resistance heater, such as a halogen lamp. And, it can be applied to the inside of at least one hollow roller and/or to the surface of at least one roller. At least one of the rollers in the heated roller fusing assembly is usually compliant, and when the rollers of the heated roller fusing assembly are pressed together under pressure, the compliant roller then deflects to form a fusing nip.

Most heat transfer between the surface of the fusing roller and the toner occurs in the fusing nip. In order to minimize "offset," which generally refers to the amount of toner that adheres to the surface of the fuser roller, release oil is typically applied to the surface of the fuser roller. Release oil is generally made of silicone oil plus additives that improve the attachment of the release oil to the surface of the fuser roller and that also dissipate static charge buildup on the fuser rollers or fused prints. During imaging, some of the release oil attaches to the imaged and background areas of the fused prints.

The toner image resident on the surface of the imaging member, such as a photosensitive member or dielectric insulating member, may be transferred to a receiver material using a variety of different methods. For example, the transfer may be a direct transfer to the receiver material. Alternatively, the transfer may be an intermediate transfer in which toner is first transferred to an intermediate transfer medium and then transferred a second time in a second transfer station to the final receiver material. Other methods might also be used.

Various printers might have different printing capabilities depending on their design and their particular operational configurations. For example, different printers might have different imaging speeds. Some printers might be designed for low-capacity use and therefore might only be capable of imaging a relatively small number of pages within a given amount of time. Other printers, however, might be designed for high-capacity use and therefore might be capable of imaging a relatively large number of pages within the same amount of time.

In another example of differing print capabilities, some printers might only be capable of printing on a single side of a receiver material. Printing on a single side of a receiver medium is oftentimes referred to as simplex printing. Other printers might be capable of printing on both sides of a receiver material, which is oftentimes referred to as duplex printing. Duplex printing may be used in a variety of different applications, such as commercial printing applications and other high-volume applications. However, it might also be used in low-volume applications and non-commercial applications.

Conventional duplex imaging systems, however, may have various disadvantages. For example, many conventional duplex imaging systems require the receiver to pass through the system multiple times. U.S. Pat. No. 4,095,979 teaches transferring a first image to a first side of a copy sheet, inverting the copy sheet while the first image thereon remains unfixed, transferring the second unfixed image to the second side of the copy sheet, and then transporting the copy sheet with the first and second unfixed images to a fixing station.

U.S. Pat. Nos. 4,191,465, 4,212,529, 4,214,831, 4,477,176, 5,070,369, 5,070,371, 5,070,372, and 5,799,236 all teach the use of inverters, turn around drums, turn over stations and the like that require a receiver to make multiple passes through the system in order to image on both sides of the receiver. These systems, and others like them, require special handling of the receiver, which can reduce the speed with which the systems can perform duplex imaging.

U.S. Pat. Nos. 5,799,226, 5,826,143, 5,899,611, 5,905,931, 5,970,277, 5,930,572, 5,991,563, and 6,038,410 generally pertain to an apparatus in which a single photoconductor carrying a toner image comes into contact with a single intermediate transfer belt and transfers the image to the intermediate transfer belt at a first transfer station using a corona device. The intermediate transfer belt temporarily holds the first image and transports it in a similar fashion to permit the transfer of a second image from the photoconductor to the top side of a receiver sheet at a first transfer station.

The belt then carries the receiver sheet with the top side image to a second transfer station at which the first image on the intermediate transfer belt is transferred to the bottom side of the receiver sheet. The receiver sheet with duplex images is then transported to a fixing station. Because the intermediate transfer belt temporarily holds the first image for a period of time representing one cycle of the intermediate transfer belt, the speed with which these systems can perform duplex imaging may also be limited. This can be disadvantageous for high-volume and high-speed imaging applications.

Directed aerosol toner development, in the general field of direct electrostatic printing, is an alternative to traditional electrophotographic systems. In directed aerosol toner development, a photoconductor is not required for image formation. Toner in the state of an airborne aerosol may be directed in an image-wise fashion to the surface of an insulating dielectric surface. Alternatively, a real image of toner particles may be written directly on a suitable recording medium. The real toner image is then formed without the need for the charging and exposure steps used in conventional electrophotographic systems.

In addition, a simpler dielectric medium can be used to receive charged particles directly comprising a latent image of charges on the surface. Charged particles include, for example, ions (e.g., cations and anions), dry toner (e.g., electrophotographic and electrographically applied powder paint) and liquid toners (e.g., aqueous, non-aqueous, organic, inorganic, and inks). These are merely examples, and other charged particles might be used.

Light is generally not required in direct electrostatic printing systems, and therefore they also generally do not require the optical sub-systems that are used in conventional electrophotographic systems. In direct electrostatic printing, an aperture array print head system can be used to directly create either a latent image of charged ions that can be subsequently developed with toner material or to directly create a real image of toner particles. Such systems are described in various U.S. patents; however, these systems suffer from many of the same process speed and other disadvantages as electrophotographic systems when performing duplex imaging.

Therefore, there exists a need for improved systems for duplex imaging.

SUMMARY OF THE INVENTION

An imaging system may use pulsed dc voltages to synchronously image on both sides of a receiver material. For example, the imaging system may image on both sides of the receiver material in a single pass of the receiver material through the system.

The imaging system may include photoconductors and use electrophotographic processes to image on the receiver material. The photoconductors may operate using discharged area development ("DAD") mode, charged area development ("CAD") mode or a combination of the two modes. Alternatively, the imaging system may use directed charged particle or aerosol toner development processes to image on the receiver material.

In exemplary embodiments, the imaging system may use intermediate transfer members that can hold a single image or can be 2-up or greater rollers. They may also be split rollers or non-split rollers.

These as well as other aspects and advantages of the present invention will become apparent from reading the following detailed description, with appropriate reference to the accompanying drawings.

BRIEF DESCRIPTION OF THE DRAWINGS

Exemplary embodiments of the present invention are described herein with reference to the drawings, in which.

DETAILED DESCRIPTION OF EXEMPLARY EMBODIMENTS

Figure 1:
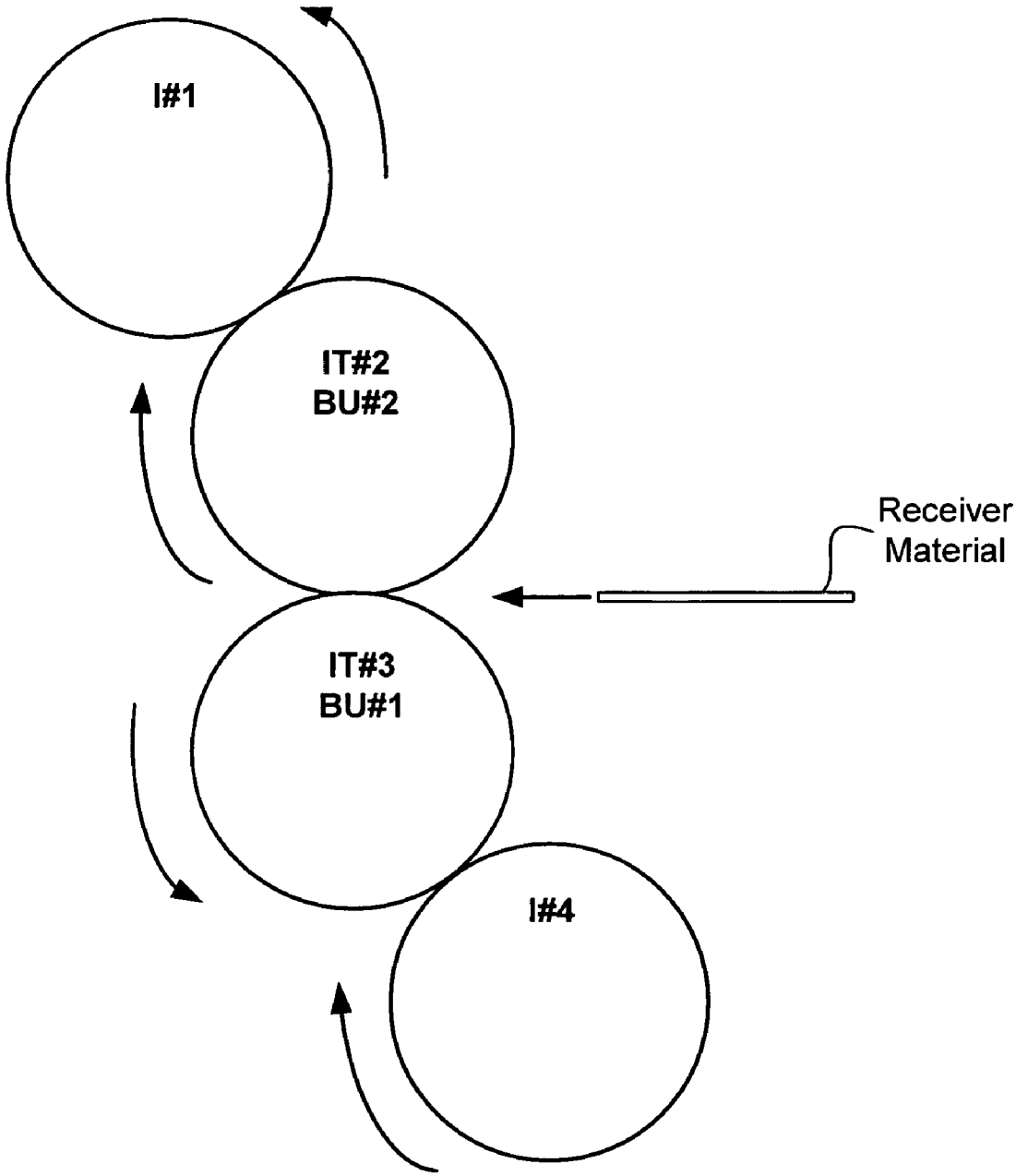
FIG. 1 is a block diagram of an exemplary double-sided image formation system using pulsed dc voltages in which images can be created on both sides of a receiver material in a single pass of the receiver material.

Electrographic or electrophotographic copiers or printers (collectively referred to herein as "printers") are used in a variety of different imaging applications. Various different architectures might be used for these systems. These architectures may depend on the particular methods used to transfer an image to a receiver material as well as the particular imaging mode(s) supported by the printer. While the examples herein may generally refer to printers, it should be understood that they may also apply to copiers, offset press systems, lithographic press systems and various other imaging systems.

They may also apply to other powder deposition systems, some of which may be capable of printing on metals. Powder deposition devices and techniques are discussed in co-pending U.S. Provisional Patent Application Ser. No. 60/551,464, titled "Powder Coating Apparatus and Method of Powder Coating Using an Electromagnetic Brush," filed on Mar. 9, 2004, which is commonly assigned, and which is incorporated herein by reference.

A printer may support imaging on one side of an image receiver material (e.g., simplex mode or simplex printing). The printer might additionally support synchronously imaging on both sides of the image receiving material (e.g., duplex mode or duplex printing). That is, the printer may make an image on one side of the receiver material, or the printer may make images on both sides of the receiver material. Printers may support one or both of these different printing modes.

In exemplary architectures, the printer can be a single pass printer. In this type of printer, the receiver material might only need to pass through the printer once in order to synchronously image on the both sides of the receiver material. As discussed herein, various exemplary printers might employ architectures and methods that use a reduced number of internal steps in order to image on both sides of the receiver material. This might advantageously increase the speed with which the printer can perform duplex printing.

In one exemplary embodiment, the printer is a single pass, duplex mode printer that uses two photosensitive photoconductors drums and two intermediate transfer drums, but the printer does not use any secondary transfer rollers. Implementing the system without secondary transfer rollers can advantageously reduce the number of steps needed to transfer an image to both sides of the receiver material, which can provide improved process speeds over conventional systems that use secondary transfer rollers or other such intermediate processing steps.

The printer might use various different types of intermediate transfer members, such as intermediate transfer drums. In one embodiment, the printer uses 2-up split intermediate transfer members. A 2-up split member generally has two separate portions that can be independently biased and that can carry separate images. While the two separate portions are generally halves of the 2-up split member, non-symmetric portions might also be used. The independent nature of the two portions allows them to be biased to different voltages. Thus, the two portions of one 2-up split member might be simultaneously biased to different voltages or to the same voltage.

In the examples discussed herein, the split rollers are depicted and described as 2-up split rollers. That is, the split rollers have two distinct electrical regions. However, the split rollers may alternatively be divided into three or more distinct electrical regions, and each of the three or more distinct electrical regions may be independently biased.

Other embodiments might use intermediate transfer members that are not split members. A non-split intermediate transfer member generally comprises a single portion that is biased to one particular voltage. In other embodiments, combinations of 2-up split intermediate transfer rollers and non-split intermediate transfer rollers might be used.

The printer might use a variety of different methods to transfer images to the receiver material. For example, the printer might use various electrophotographic processes that employ toner or other magnetic carriers in order to create an image on one or both sides of the receiver material. Exemplary development systems that implement hard magnetic carriers are described in U.S. Pat. Nos. 4,473,029 and 4,546,060, the contents of which are incorporated by reference as if fully set forth herein. Other development systems implement magnetic carriers that are not hard (i.e. soft), and these may also be used. In these systems, the toning shell and/or toning magnet may or may not rotate, and other variations are also possible.

Directed aerosol toner development might alternatively be used to transfer the image to the receiver material. In directed aerosol toner development systems, a simple dielectric medium may be used in place of the photoconductor to receive charged particles directly comprising a latent image of charges on the surface. As an alternative, a real image of toner particles may be written directly on a suitable recording medium. In one particular embodiment, charged ions formed by the electrical breakdown of air may be written directly onto a suitable dielectric medium and subsequently developed with toner. In another embodiment, the real image on the imaging medium may be formed by projecting charged particles, such as toner particles.

Light is typically not required in directed aerosol toner development systems. Rather, an aperture print array can be used to directly create either a latent image of charged ions that can then be later developed with toner material or a real image of toner particles. Aperture print arrays typically include a plurality of front-to-back printing apertures formed through an insulating material, individually addressable control electrodes surrounding each printing aperture on one side, and a contiguous shield electrode on the other side. Thus, a flow of ions or toner particles to an image receiving member from an appropriate source of ions or toner in an electric field is image-wise modulated by the aperture print array.

FIG. 1 is a block diagram of an exemplary double-sided image formation system using pulsed dc voltages in which images can be created on both sides of a receiver material in a single pass of the receiver material. The receiver material may be any type of receiver material, such as paper, overhead projector ("OHP") transparency materials, envelopes, mailing labels, and sheetfed offset or webfed offset preprinted shells, metals, metalized substrates, semi-conductors, fabrics or other materials. In this exemplary system, the receiver material is transported through the transfer station only once, and the image transfer to both sides of the receiver material occurs synchronously during this single pass. This can advantageously allow the system to maintain a relatively high process speed during duplex printing.

Various different imaging methods might be used. For example, the system might use electrophotographic development processes, such as discharged area development ("DAD"), charged area development ("CAD") or a combination of the two methods. In one embodiment, both photoconductors might operate in the DAD mode or they both might operate in the CAD mode. Alternatively, one photoconductor using negatively charged toner might operate in the DAD mode, while the other photoconductor using positively charged toner might operate in the CAD mode. Other methods, such as directed aerosol toner development or other direct electrostatic printing processes, might also be used.

The particular-architecture of the system may vary depending on the particular imaging process and the particular implementation of that imaging process used by the system. For example, this figure illustrates an exemplary drum architecture. However, a photoconductor belt, a continuous flexible seamless dielectric belt or other architectures might alternatively be used.

As illustrated in FIG. 1, the system includes two imaging members. These two imaging members are labeled I#1 and I#4 respectively. The imaging members might vary depending on the particular imaging processes. If the system uses an electrophotographic process, then the two imaging members might be photoconductors. However, if the system uses direct electrostatic printing or another such process, then the imaging members might not be photoconductors but rather might be some other type of imaging member that is appropriate for that process.

The system also includes two intermediate transfer members, which are labeled IT#2 and IT#3 respectively. The each imaging member works together with its respective intermediate transfer member to image on one side of the receiver material. The first imaging member I#1 and the first intermediate transfer member IT#2 image on the first side of the receiver material, while the second intermediate transfer member IT #3 and the second imaging member I#4 image on the other side of the receiver material.

Images on the surfaces of the imaging members I#1, I#4 can be transferred to the intermediate transfer members IT#2, IT#3. As illustrated, the first intermediate transfer member IT#2 serves as a backup roller for the second intermediate transfer member IT#3 in the paper transfer nip. Similarly, the second intermediate transfer member IT#3 serves as a backup roller for the first intermediate transfer member IT#2 in the paper transfer nip.

The process speed is generally determined from the surface speed of the intermediate transfer members IT#2, IT#3. The intermediate transfer members IT#2, IT#3 preferably operate at the same velocity, such as at the same angular velocity. The intermediate transfer members IT#2, IT#3 preferably have the same diameter, and therefore also have the same surface velocity in addition to having the same angular velocity. The image members I#1, I#4 preferably have the same velocity as the intermediate transfer members IT#2, I#3, such that all four members I#1, IT#2, I#3, I#4 then rotate at the same velocity.

In one preferred embodiment, the imaging members I#1, I#4 are 2-up rollers that have distinct electrically contiguous surfaces, and the two intermediate transfer members IT#2, IT#3 are also 2-up split rollers. The total surface area of each of the split rollers is split or separated into two equal areas with distinct and electrically isolated regions. One half of each cylindrical split roller may be biased to one voltage, while the other half may be biased to a different voltage. Thus, the voltages of the two halves of one split roller may be the same or different.

The two intermediate transfer members IT#2, IT#3 form a single toning nip that is used to synchronously image on both sides of the receiver material. For example, the toner images on one of the split surfaces of the first intermediate transfer member IT#2 can be transferred under the influence of an electric field to one side of the receiver material. Similarly, the toner image on one of the split surfaces of the second intermediate transfer member IT#3 can synchronously be transferred to the other side of the receiver material through another electric field.

The double-sided transfer of toner images from the 2-up imaging members I#1, I#4 to the 2-up split intermediate transfer members IT#2, IT#3 and finally to both sides of the receiver material can operate at the full process speed capability of the printer, since the 2-up split intermediate transfer members IT#2, IT#3 are not required to temporarily transport the image frame for a second cycle in order to synchronize the transfer of the two images. Also, the synchronous transfer of images to both sides of the receiver material in a single transfer nip defined by the contact of the two image transfer members advantageously does not require more than one transfer station.

I. EXAMPLE 1

Hybrid Split Roller Duplex Printing Using Pulsed DC Fields (Negative Toner)

This example illustrates an exemplary four-roller system in which each of the different rollers may carry differing dc voltages and in which one or more rollers may use pulsed dc voltages. In this exemplary embodiment, the intermediate transfer members IT#2, IT#3 are 2-up split rollers whereas the imaging rollers I#1, I#4 are not split rollers. It should be noted that systems employing different combinations of split rollers and non-split rollers might be used, or the rollers might all be of the same type.

Each different region of the rollers might carry a different dc voltage. The particular dc voltages are selected to allow development of negatively charged toner onto the surface of the imaging rollers I#1, I#4. The dc voltages are also selected to allow the transfer of negatively charged toner onto the surfaces of the 2-up split intermediate transfer rollers IT#2, IT#3. A dc bias voltage is applied to the appropriate regions of the 2-up split intermediate transfer rollers IT#2, IT#3. This permits the synchronous duplex transfer of the toner on the split surfaces of the intermediate transfer rollers IT#2, IT#3 onto both sides of a receiver material passing through a single nip formed between the intermediate transfer rollers IT#2, IT#3.

One or more of the rollers I#1, IT#2, I#3, I#4 may use pulsed dc or ac voltages. The pulsed dc or ac voltages may also permit the synchronous duplex transfer of the toner on the appropriate surfaces of the intermediate transfer rollers IT#2, IT#3 onto both sides of a receiver material passing through the nip.

A pulsed dc waveform may be similar to a square wave. An exemplary square wave is depicted in Table 1. The waveform may be characterized by three parameters: pulse amplitude (e.g., measured in volts), pulse frequency or pulse rate (e.g., measured in Hz), and pulse duration or pulse width (e.g. measured in milliseconds). Pulse duration is sometimes referred to as mark. Pulse width may be adjusted to various duty cycles for example 50% duty cycle or 80% duty cycle. Pulsed dc changes voltage from zero to a positive (or negative) value and back to zero at the frequency rate; however, it might alternatively switch between other voltages.

TABLE 1

Exemplary DC Waveform

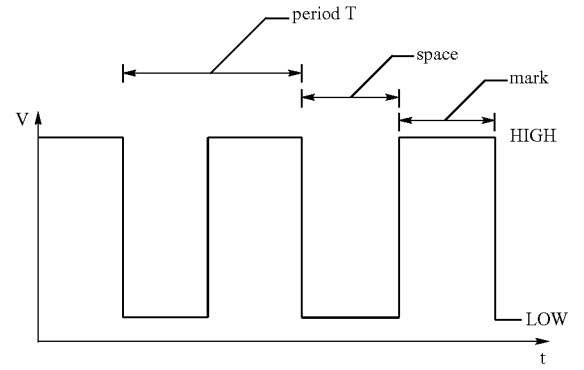

By comparison a pulsed ac waveform is more analogous to a sine wave, which changes the voltage from positive to negative and back to positive according to the frequency rate. Table 2 depicts an exemplary pulsed ac waveform. Direct current (dc) flows only in one direction, but alternating current (ac) continually changes directions back and forth at a rate set by the frequency.

TABLE 2

Exemplary AC Waveform

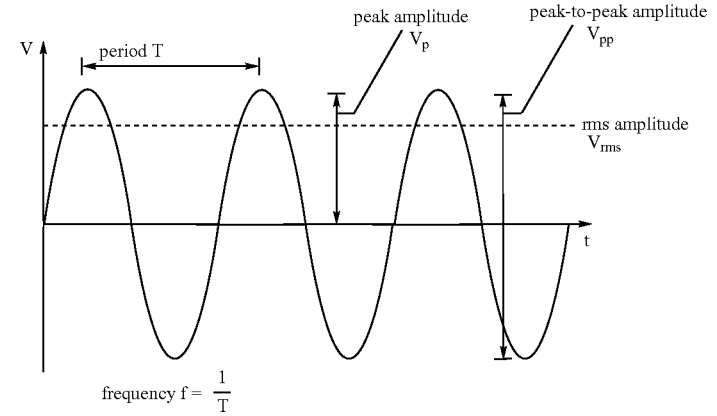

Pulsed dc power supplies typically provide pulsed dc at frequencies between 100 mHz to 50 MHz; however the particular range of possible voltage may vary between dc power supplies with some power supplies providing voltages outside this range. The pulse dc generators are also typically capable of independently programmable rise and fall times from 3 ns to 1 s. The possible rise and fall times will also vary depending on the particular dc power supply, and some dc power supplied may provide rise and fall time outside this range.

By comparison an ac waveform at 400 Hz would have a rise and fall time of 0.5 msec, and an ac waveform of 1000 Hz would have a rise and fall time of 0.2 msec. The rise and fall times are much faster for pulsed dc square waves and this may be important for reducing lead and trail edge image quality effects for transferring lines and solid areas.

The system may use different cycles, such as image and transfer cycles, to image onto the receiver material. Exemplary cycles for this system are described in more detail below and with reference to FIGS. 2-4, which illustrate preferred biases that might be used during the respective cycles. The solid black arrows generally located within the rollers show the electric field vectors corresponding to the particular biases, while the thinner black arrows generally located around the rollers show the direction of physical rotation of the rollers.

A. Cycle 1—Image Cycle

Figure 2:
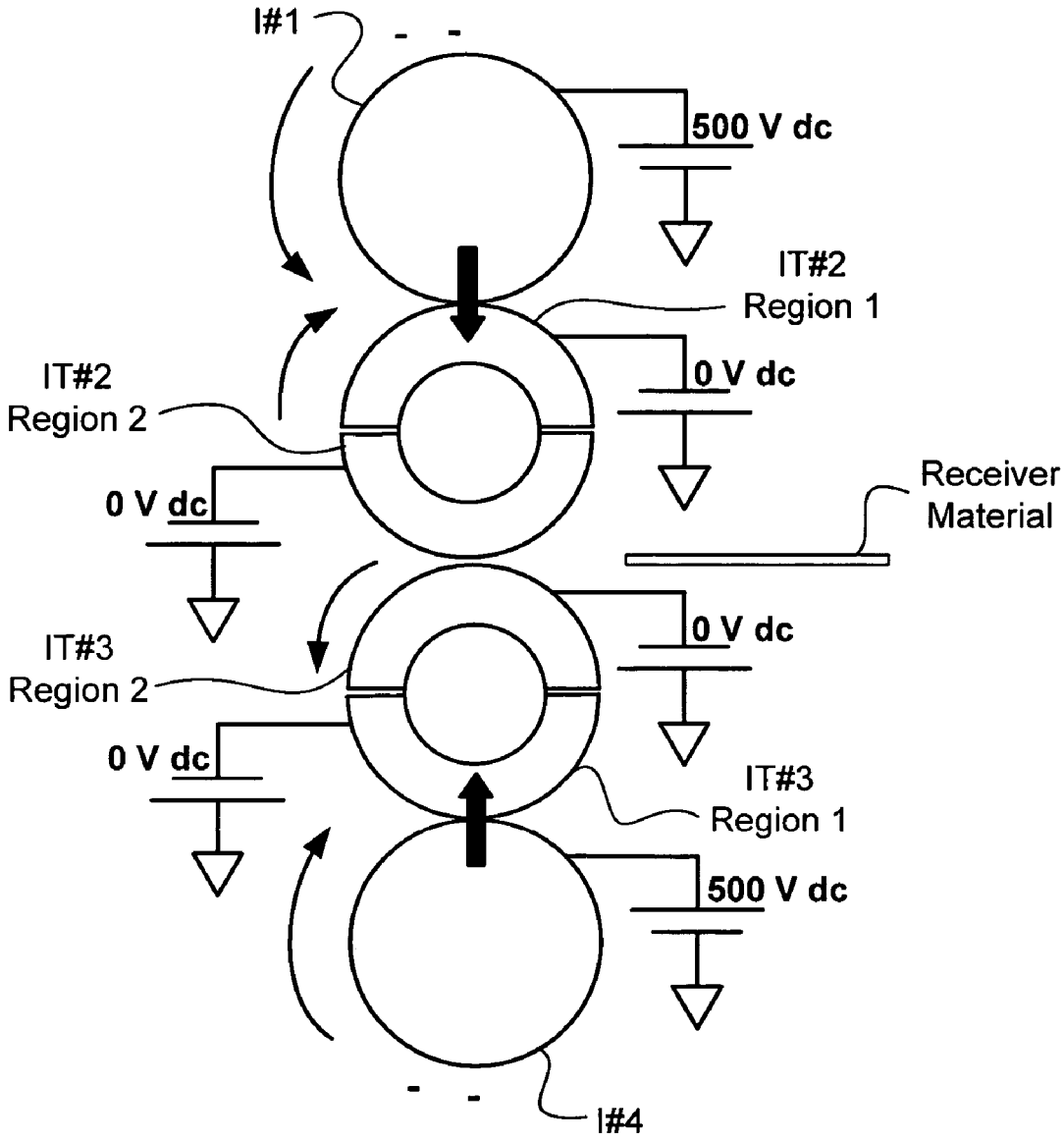
FIG. 2 illustrates an exemplary imaging cycle for a hybrid split roller imaging system using pulsed dc voltages and one polarity of toner.

FIG. 2 illustrates an exemplary imaging cycle for a hybrid split roller imaging system using pulsed dc voltages and one polarity of toner. As described herein, this system uses directed charged particle or aerosol toner development methods. However, it might alternatively use electrophotographic method. For example, negative toner may be developed onto the surface of photoconductor rollers using discharged area development ("DAD") or charged area development ("CAD"). It should also be noted that the photoconductors used in electrophotographic methods need not be the same, their structures and materials may different.

During the imaging cycle, negative toner is imaged onto the surface of imaging rollers I#1, I#4 using directed aerosol toner development. In the case of directed aerosol toner development, an aperture array print head is modulated to write directly onto insulating dielectric surfaces in an imagewise fashion. The electrical substrates of imaging rollers I#1, I#4 are preferably biased to +500 V dc to provide an electric field near the surface to attract and hold the negative toner. The 2-up split intermediate transfer rollers IT#2, IT#3 both have the conducting substrates for all their distinct regions preferably biased to 0 V.

In this example, all voltages are with respect to ground, which is 0 V dc. However, it should be understood that the different rollers in this or other examples might be biased with respect to voltages other than ground. Also, the particular biases described in this and the other examples are merely exemplary in nature, and other biases might also be used.

B. Cycle 2—Transfer to Intermediate Transfer Roller

Figure 3:
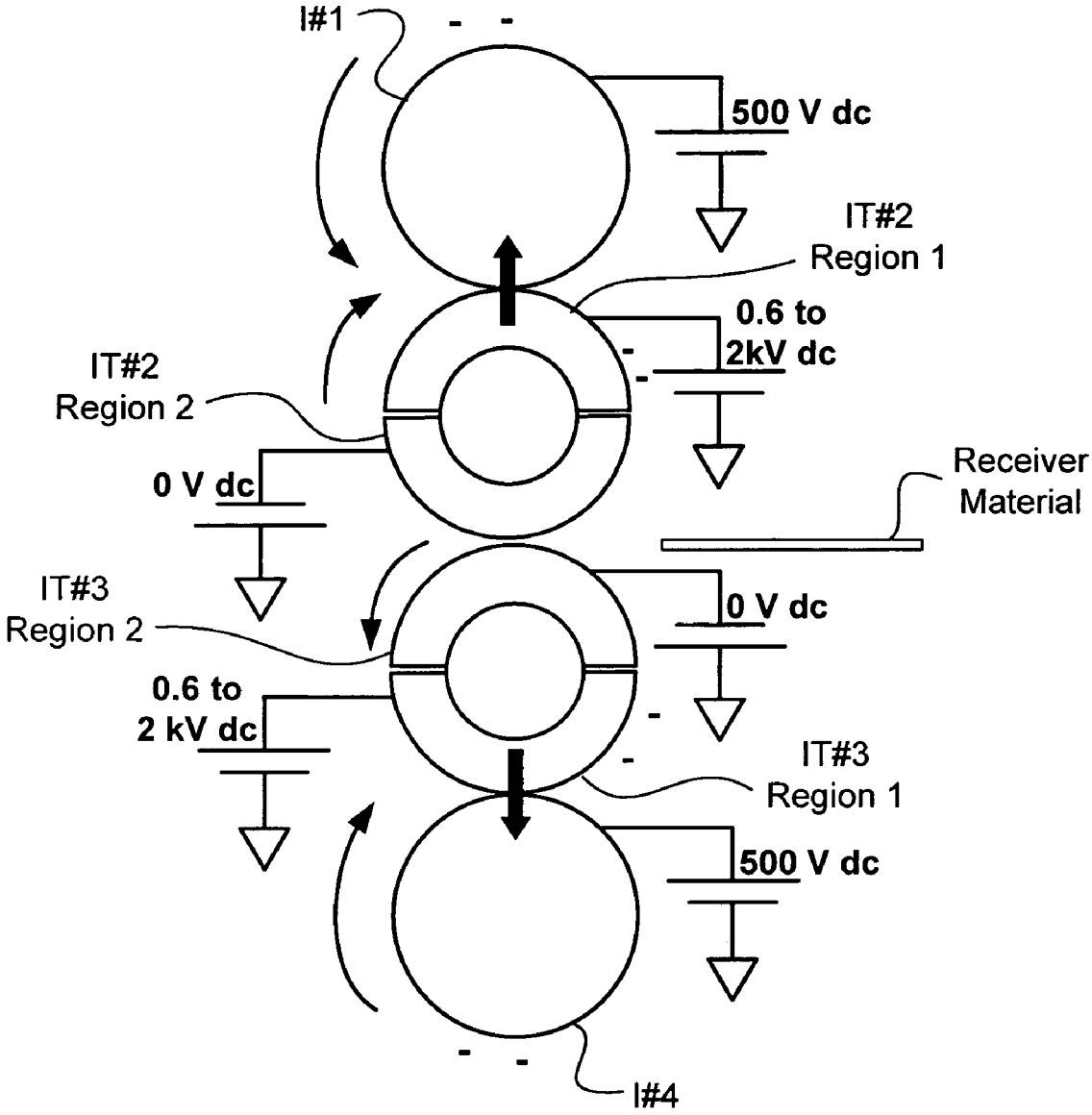
FIG. 3 illustrates an exemplary first transfer cycle for a hybrid split roller imaging system using pulsed dc voltages and one polarity of toner.

FIG. 3 illustrates an exemplary first transfer cycle for a hybrid split roller imaging system using pulsed dc voltages and one polarity of toner. In this transfer cycle, negative toner on the imaging rollers I#1 and I#4 is transferred to region 1 of each respective 2-up split intermediate transfer member IT#2, IT#3. The electrically conducting substrate for region 1 of each 2-up split intermediate transfer member IT#2, IT#3 is preferably biased to between +0.6 to 2 kV dc.

At the same time, the electrically conducting substrate of region 2 of each 2-up split intermediate transfer member IT#2, IT#3 is biased to 0 V dc. This creates an electric field gradient between region 1 of the 2-up split intermediate transfer rollers IT#2, IT#3 and their respective imaging rollers I#1, I#4. The electric field gradient enables the negatively charged toner to leave the imaging rollers, I#1, I#4 and move to the surface of the 2-up split intermediate transfer members IT#2, IT#3.

C. Cycle 3—Transfer of Toner to Receiver

Figure 4:
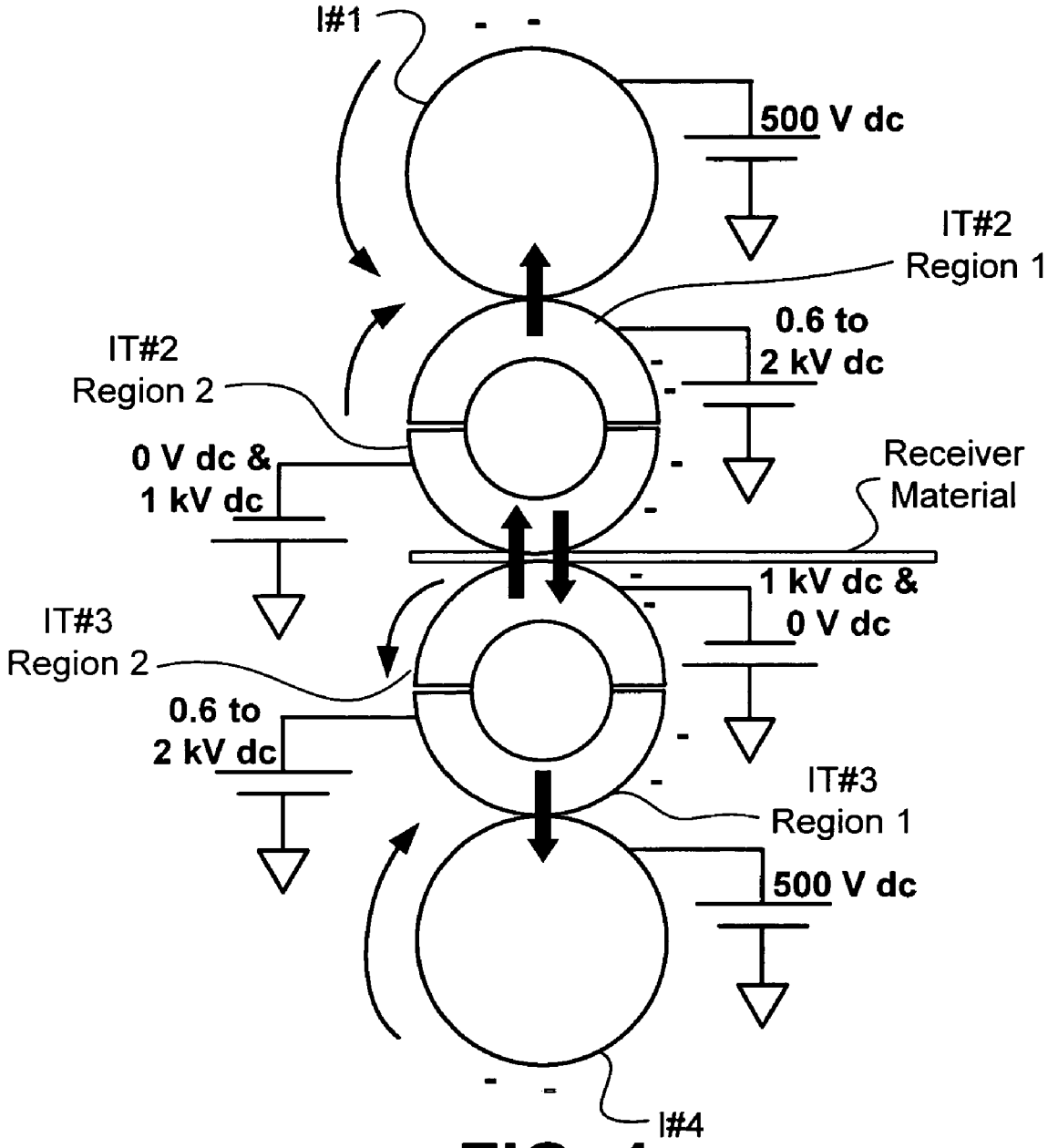
FIG. 4 illustrates an exemplary second transfer cycle for a hybrid split roller imaging system using pulsed dc voltages and one polarity of toner.

FIG. 4 illustrates an exemplary second transfer cycle for a hybrid split roller imaging system using pulsed dc voltages and one polarity of toner. During this transfer cycle, negative toner on region 2 of the first intermediate transfer roller IT#2 is transferred to one side of the receiver material in the nip formed between the 2-up split intermediate transfer rollers IT#2, IT#3. Also during this cycle, the negative toner on region 2 of second intermediate transfer roller IT#3 is transferred to the other side receiver sheet in the transfer nip.

During this cycle, the conducting substrate of region 2 of the first 2-up split intermediate transfer roller IT#2 is biased to 0 V dc. At the same time, region 2 of the second 2-up split intermediate transfer roller IT#3 is biased to +1 kV dc. This establishes an electric field across the nip between the two 2-up intermediate transfer rollers IT#2, IT#3. The negative toner on the first intermediate transfer member IT#2 moves in this electric field to one side of the receiver sheet.

At a frequency of between approximately 0.4 to 1 kHz, the bias on the first intermediate transfer roller IT#2 is switched to +1 kV. At the same time, the voltage bias on the conducting substrate of the second intermediate transfer roller IT#3 is switched to 0 V dc. The electric field vector across the nip formed between the two 2-up split roller intermediate transfer rollers IT#2, IT#3 is changed in its direction at a frequency of approximately 0.4 to 1 KHz. The electric field points toward the second intermediate transfer roller IT#3 and then toward the first intermediate transfer member IT#2. This enables negative toner to transfer to the first and second sides of the receiver material in a synchronous manner.

One additional cycle, cycle 4, can be used to create two duplex pages with four images contained on their first and second sides. This cycle would then be a repeat of cycle 3.

D. Exemplary Biasing Effects

In the Imaging Cycle 1, a 500 V dc bias is applied to the core of the imaging rollers I#1, I#4 to hold the real toner image created by the directed aerosol toner development process or the negative toner developed by conventional electrophotographic methods.

During Transfer Cycle 2 up to a 1.5 kV difference exists between the first imaging roller I#1 and the first intermediate transfer roller IT#2, and between the second imaging roller I#4 and the second intermediate transfer roller IT#3. This voltage difference enables the negatively charged toner on the surface of the imaging rollers. I#1, I#4 to transfer to the appropriate surfaces of the 2-up split roller intermediate transfer rollers IT#2, IT#3.

During Transfer Cycle 3, a 1 kV difference is created between the intermediate transfer rollers IT#2, IT#3 in a pulsed dc manner. A 0 V dc bias is applied to the first intermediate transfer roller IT#2, while at the same time a +1 kV dc bias is applied to the second intermediate transfer roller IT#3. At a frequency of 400 Hz to 1 kHz, the biases on the two intermediate transfer rollers IT#2, IT#3 are reversed. That is, a 0 V dc potential is applied to the second intermediate transfer roller I#3, while a +1 kV dc bias is applied to the first intermediate transfer roller IT#2.

This pulsed dc voltage difference establishes an alternating electric field between the two intermediate transfer rollers IT#2, IT#3. The electric field enables the negatively charged toner on the surface of the first intermediate transfer roller IT#2 to transfer to one side of the receiver material in the nip during one phase of the pulsed dc or ac field. During the next phase of the pulsed dc or ac field, the negatively charged toner on the surface of the second intermediate transfer roller IT#3 is transferred to the other side of the receiver material.

Although a 1 kV voltage difference has been illustrated for transferring negative toner to each side of a receiver material using the pulsed dc field, higher or lower voltages may also be used. In addition, the frequency of the pulsed dc may be less than 400 Hz or greater than 1 kHz. The pulsed dc transfer may have an increased efficiency over traditional systems, since any wrong sign (e.g., positively charged) toner or poorly charged toner will also be transferred to each side of the receiver material under the influence of the pulsed dc fields.

One advantage of this implementation is that only one polarity of toner needs to be used in identical directed aerosol development systems to develop the negative toner onto the surfaces of the imaging rollers I#1, I#4. Controlling the voltage bias on the individual rollers may be easier than using two different toners (e.g., a negatively and a positively charged toner) and the different development systems that would be required to support those different types of toners.

II. EXAMPLE 2

Hybrid Split Roller Duplex Printing Using Pulsed DC Fields (Negative and Positive Toners)

In the previous example, only one polarity of toner was used to image on both sides of the receiver material. However, the printing system might alternatively use both positive and negative toners to image on both sides of a receiver material.

A. Cycle 1—Image Cycle

Figure 5:
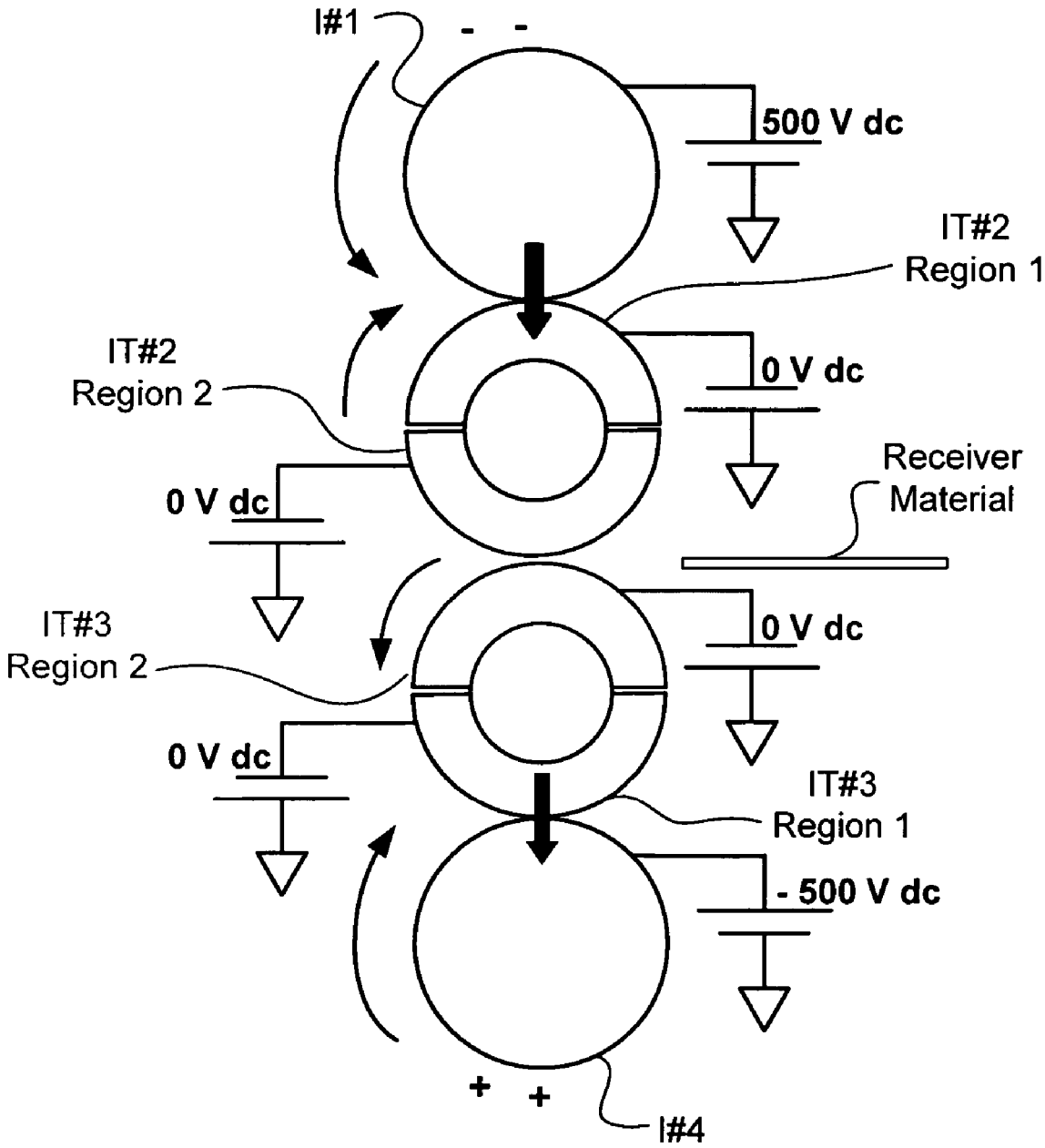
FIG. 5 illustrates an exemplary imaging cycle for a hybrid split roller imaging system using pulsed dc voltages and two polarities of toner.

FIG. 5 illustrates an exemplary imaging cycle for a hybrid split roller imaging system using pulsed dc voltages and two polarities of toner. During the imaging cycle, negative toner is imaged onto the surface of the first imaging roller I#1 and positive toner is imaged onto the surface of the second imaging roller I#4 using directed aerosol toner development. As previously described, negative and positive toners may also be developed onto the surfaces of the photoconductor rollers using DAD or CAD processes, when an electrophotographic system is used.

The electrical substrate of the first imaging roller I#1 is biased to +500 V dc to provide an electric field near the surface to attract and hold the negative toner. The electrical substrate of the second imaging roller I#2 is biased to −500 V dc to provide an electric field near the surface to attract and hold the positive toner. During the imaging cycle, the 2-up split roller intermediate transfer rollers IT#2, IT#3 have the electrically conducting substrates for their distinct regions biased to 0 V dc.

B. Cycle 2—Transfer to Intermediate Transfer Roller

Figure 6:
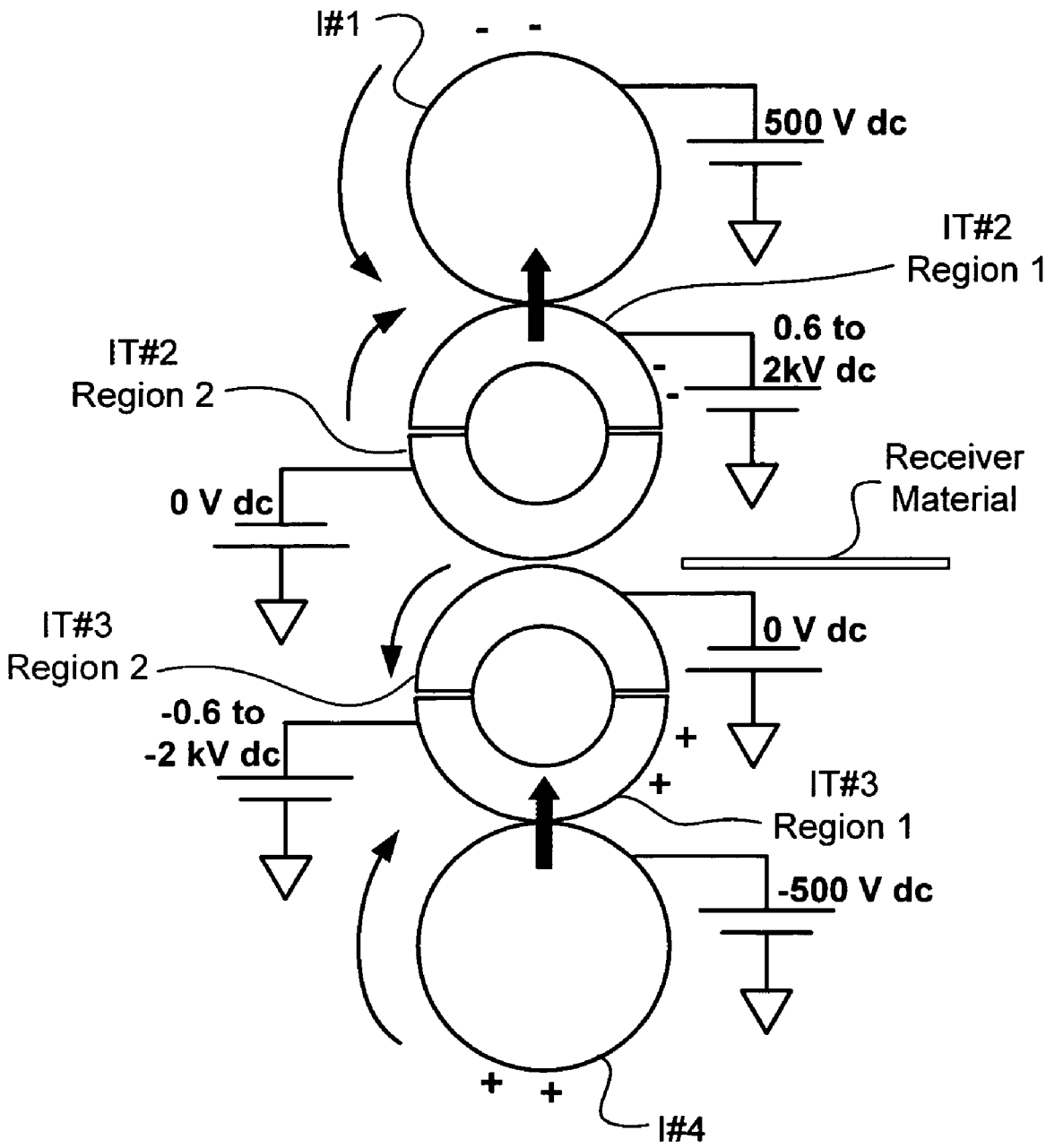
FIG. 6 illustrates an exemplary first transfer cycle for a hybrid split roller imaging system using pulsed dc voltages and two polarities of toner.

FIG. 6 illustrates an exemplary first transfer cycle for a hybrid split roller imaging system using pulsed dc voltages and two polarities of toner. In this transfer cycle, negative toner on the first imaging roller I#1 and positive toner on the second imaging roller I#4 is transferred to region 1 of each respective 2-up split intermediate transfer members IT#2, IT#3. The electrically conducting substrates for region 1 of both 2-up split roller intermediate transfer members IT#2, IT#3 are biased to between +0.6 to +2 kV dc for the first intermediate transfer member IT#2 and between −0.6 to −2 kV dc for the second intermediate transfer member IT#3.

At the same time the electrically conducting substrates of region 2 of each 2-up split intermediate transfer member IT#2, IT#3 is biased to 0 V dc. This creates an electric field gradient between region 1 of each intermediate transfer roller IT#2, IT#3 and the respective imaging rollers I#1, I#4 that enables the negative and positive toner to leave the imaging rollers I#1, I#4 and to move to the surface of the 2-up split intermediate transfer members IT#2, IT#3.

C. Cycle 3—Transfer of Toner to Receiver

Figure 7:
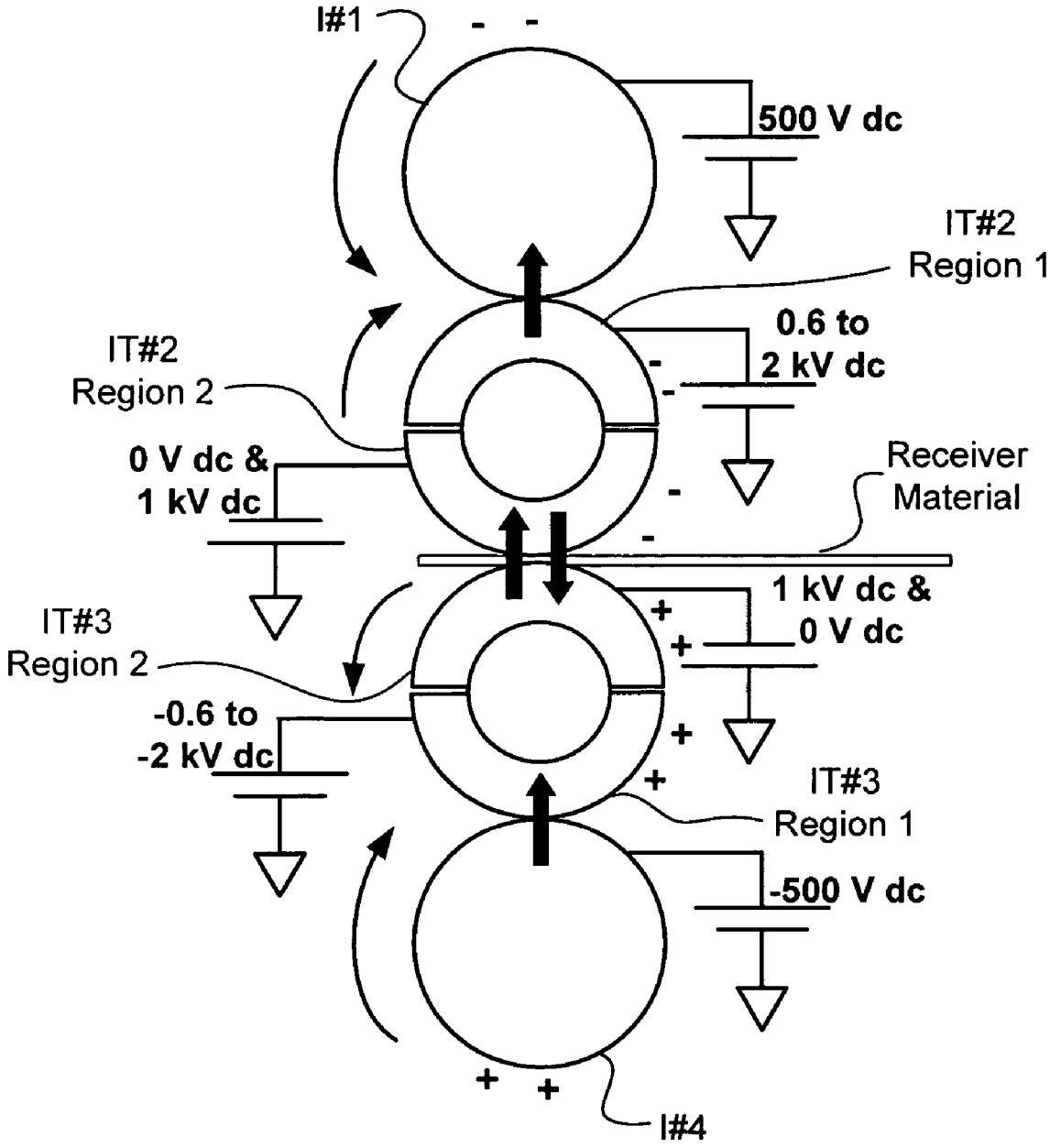
FIG. 7 illustrates an exemplary second transfer cycle for a hybrid split roller imaging system using pulsed dc voltages and two polarities of toner.

FIG. 7 illustrates an exemplary second transfer cycle for a hybrid split roller imaging system using pulsed dc voltages and two polarities of toner. During this transfer cycle, negative toner on region 2 of the first intermediate transfer roller IT#2 is transferred to one side of the receiver material in the transfer nip between 2-up split intermediate transfer rollers IT#2, IT#3. Also during this cycle, the positive toner on region 2 of the second intermediate transfer roller IT#3 is transferred to the other side of the receiver material in the nip.

The conducting substrate of region 2 of the first 2-up split intermediate transfer roller IT#2 is biased to 0 V dc. At the same time, region 2 of the second 2-up split intermediate transfer roller IT#3 is biased to +1 kV dc. This establishes an electric field across the nip between the intermediate transfer members. The negative toner on the first intermediate transfer member IT#2 moves in this electric field to the top of the receiver material. At a frequency of between approximately 0.4 to 1 kHz, the bias on the first intermediate transfer member IT#2 is switched to +1 kV. At the same time, the voltage bias on the conducting substrate of the second intermediate transfer member IT#3 is switched to 0V dc.

Accordingly, the electric field vector across the nip formed between the two 2-up split roller intermediate transfer rollers IT #2, IT#3 is changed in its direction at a frequency of about 0.4 to 1 kHz. The electric field points toward the second intermediate transfer member IT#3 and then toward the first intermediate transfer member IT#2. This enables negative toner and positive toner to transfer to the first and second sides of the receiver material in a synchronous, although not simultaneously, manner.

One additional cycle, cycle 4, can be used to create two duplex pages with four images contained on their first and second sides. This cycle would then be a repeat of cycle 3.

III. EXAMPLE 3

Synchronous Duplex Printing Using Pulsed DC Fields

In this example the imaging rollers I#1 and I#4, and intermediate transfer rollers IT#2, IT#3 are single-section rollers rather than the 2-up split rollers of the previous example. Although these rollers are not split rollers, they may be capable of 2-up, 3-up or greater numbers of images depending upon their size. Each of the different rollers can be biased to a particular dc voltage. The dc voltages are selected to permit the development of negatively charged toner onto the surface of imaging rollers I#1, I#4 and are also selected to enable the transfer of the negatively charged toner onto the surface of the intermediate transfer rollers IT#2, IT#3. The selected voltages also enable the synchronous duplex transfer of the toner on the surface of the intermediate transfer rollers IT#2, IT#3 onto both sides of the receiver material passing through the nip.

A. Cycle 1—Image Cycle

Figure 8:
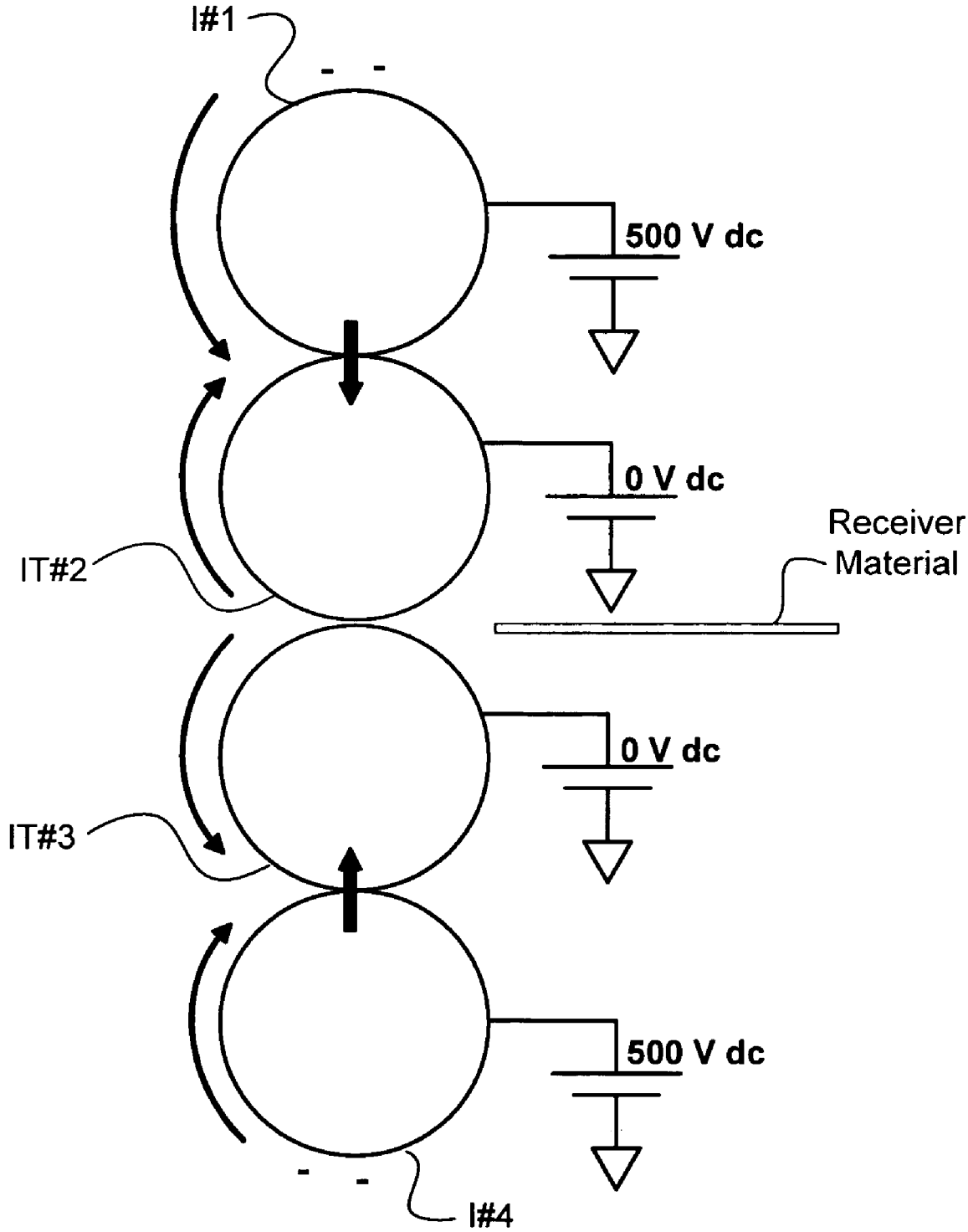
FIG. 8 illustrates an exemplary imaging cycle for a synchronous duplex printing system using pulsed dc voltages.

FIG. 8 illustrates an exemplary imaging cycle for a synchronous duplex printing system using pulsed dc voltages. During the imaging cycle, negative toner is imaged onto the surface of the imaging rollers I#1, I#4 using directed aerosol toner development. Electrophotographic processes might alternatively be used. The electrical substrates of the imaging rollers I#1, I#4 are biased to +500 V dc to provide an electric field near the surface to attract and hold the negative toner. During the imaging cycle, the intermediate transfer rollers IT#2, IT#3 have their electrically conducting substrates biased to 0 V dc.

B. Cycle 2—Transfer to Intermediate Transfer Roller

Figure 9:
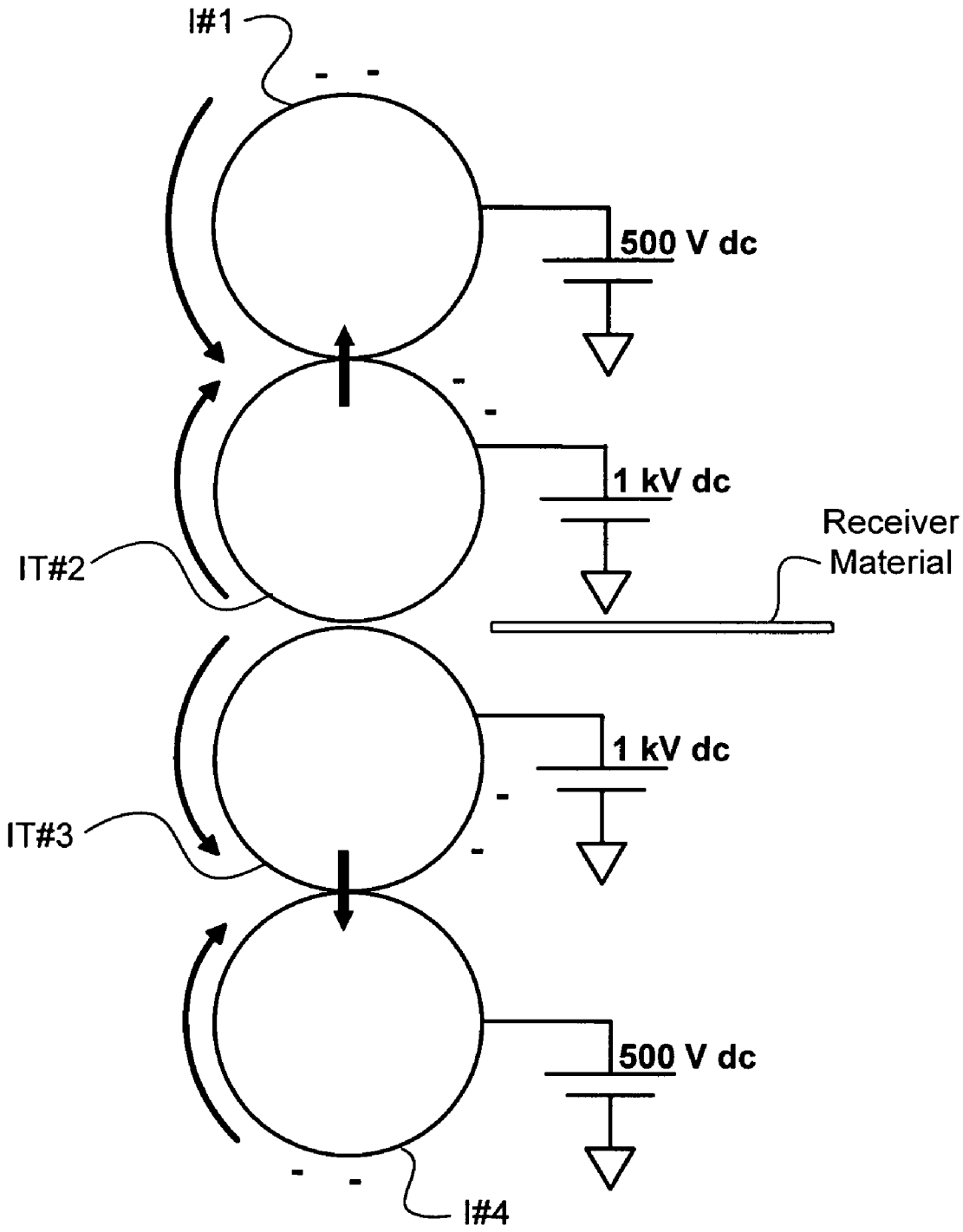
FIG. 9 illustrates an exemplary first transfer cycle for a synchronous duplex printing system using pulsed dc voltages.

FIG. 9 illustrates an exemplary first transfer cycle for a synchronous duplex printing system using pulsed dc voltages. In this transfer cycle, negative toner on the imaging rollers I#1, I#4 is transferred to the intermediate transfer members IT#2, IT#3. The electrically conducting substrates for the intermediate transfer members' IT#2, IT#3 are biased to 1000 V dc. However, the bias applied to the conducting substrate of the intermediate transfer rollers IT#2, IT#3 may alternatively be greater than 1 kV.

This biasing creates an electric field gradient between the intermediate transfer rollers IT#2, IT#3 and the imaging rollers I#1, I#4 that enables the negative toner to leave the imaging rollers I#1, I#4 and move to the surfaces of the 2-up roller intermediate transfer members IT#2, IT#3. During this transfer cycle a new image may be written onto the imaging rollers I#1, I#4.

C. Cycle 3—Transfer of Toner to Receiver

Figure 10:
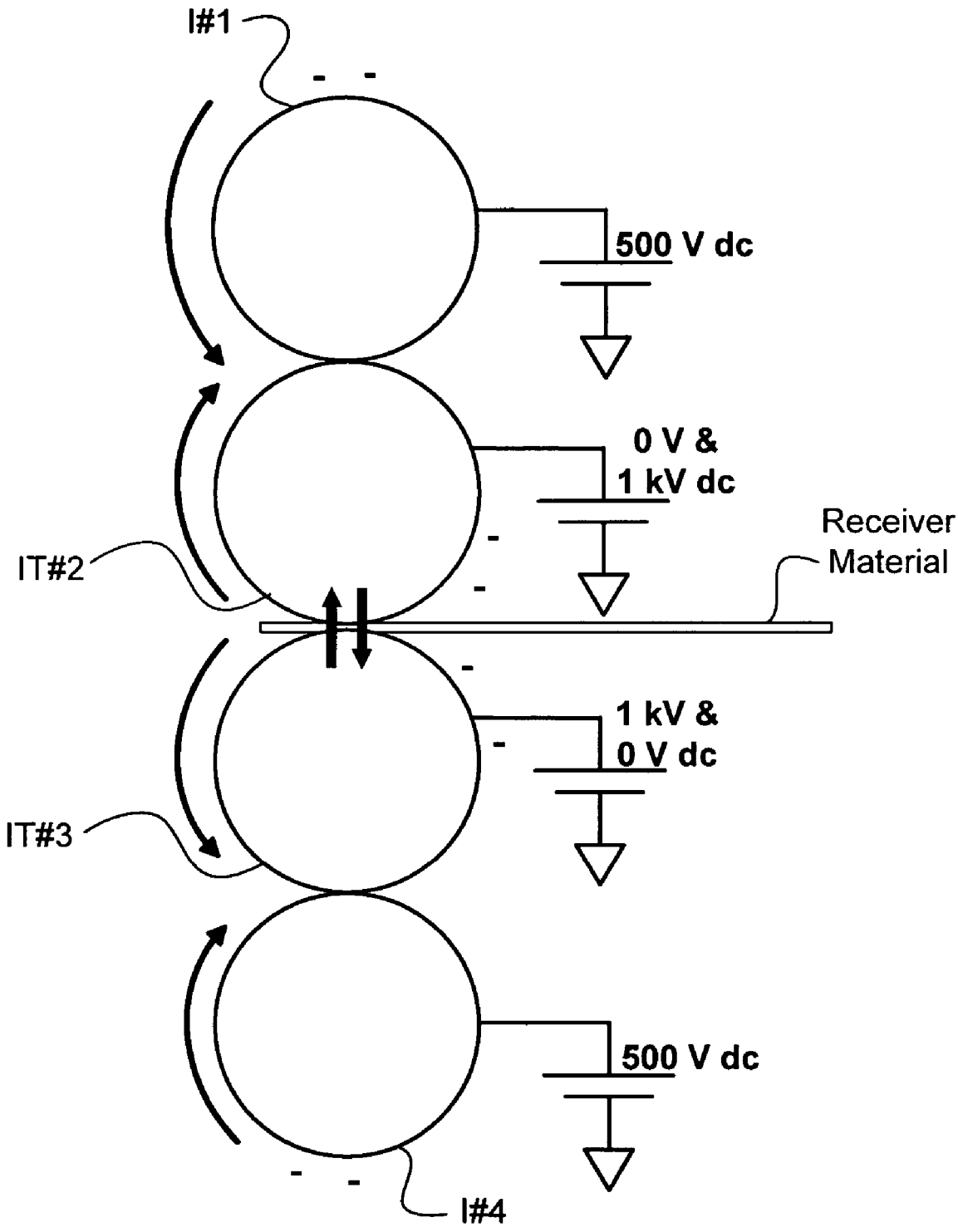
FIG. 10 illustrates an exemplary imaging cycle for a synchronous duplex printing system using pulsed dc voltages.

FIG. 10 illustrates an exemplary imaging cycle for a synchronous duplex printing system using pulsed dc voltages. During this transfer cycle, negative toner on the first intermediate transfer roller IT#2 is transferred to one side of the receiver material, and the negative toner on the second intermediate transfer roller IT#3 is synchronously transferred to the other side of the receiver material.

Also during this cycle, the conducting substrates of intermediate transfer rollers IT#2, IT#3 are subjected to a pulsed dc bias. When first intermediate transfer roller IT#2 is biased to 0 V dc, the second intermediate transfer roller IT#3 is biased to 1 kV dc. This establishes an electric field across the nip. The negative toner on the first intermediate transfer member IT#2 moves in this electric field to one side of the receiver material. During the next cycle, a 1 kV dc bias is applied to the first intermediate transfer member IT#2 and 0 V dc is applied to the second intermediate transfer member IT#3. Negative toner on the second intermediate transfer member IT#3 then moves under the influence of the electrical field to the other side of the receiver material.

During this cycle, a 1000 volt difference is created between the intermediate transfer rollers IT#2, IT#3 in a pulsed dc manner. At a frequency of between approximately 400 and 1000 Hz, the biases on the intermediate transfer rollers IT#2, IT#3 are reversed, and this pulsed dc voltage difference establishes an alternating electric field between the two intermediate transfer rollers IT#2, IT#3.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more, fewer or other elements may be used in the block diagrams. The claims should not be read as limited to the described order or elements unless stated to that effect.

In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

The invention claimed is:

1. A duplex imaging system comprising:

a first imaging assembly for imaging on a first side of a receiver material;

a second imaging assembly for imaging on a second side of the receiver material; and wherein the first and second imaging assemblies use pulsed dc voltages to synchronously image on their respective sides of the receiver material, wherein the first imaging assembly uses toner having an opposite polarity from toner used by the second imaging assembly.

2. The imaging system of claim 1, wherein the first and second imaging assemblies use directed charged particle or aerosol toner development processes to image on the receiver material.

3. The imaging system of claim 2, wherein the first imaging assembly includes a first dielectric medium and the second imaging assembly includes a second dielectric medium.

4. The imaging system of claim 1, wherein the first and second imaging assemblies use electrophotographic processes to image on the receiver material.

5. The imaging system of claim 4, wherein the first imaging assembly includes a first photoconductor and the second imaging assembly includes a second photoconductor.

6. The imaging system of claim 1, wherein the pulsed dc fields create an alternating electric field between the first and second imaging assemblies.

7. The imaging system of claim 1, wherein the first and second imaging assemblies use pulsed dc voltages having a frequency between approximately 400 Hz and 1000 Hz.

8. The imaging system of claim 1, wherein the first imaging assembly uses toner having the same polarity as toner used by the second imaging assembly.

9. A single pass printing system comprising:

a first imaging assembly for printing on a first side of a receiver material:

a second imaging assembly for printing on a second side of the receiver material; and wherein the first and second imaging assemblies uses pulsed dc voltages to print on their respective sides of the receiver material during a single pass of the receiver material through the printing system, wherein the first imaging assembly uses toner having an opposite polarity from toner used by the second imaging assembly.

10. The printing system of claim 9, wherein the first and second imaging assemblies use directed charged particle or aerosol toner development processes to print on the receiver material.

11. The printing system of claim 9, wherein the first and second imaging assemblies use electrophotographic processes to print on the receiver material.

12. The printing system of claim 9, wherein the first and second imaging assemblies use pulsed dc voltages having waveforms that are substantially square waves.

13. The printing system of claim 9, wherein the first and second imaging assemblies use pulsed dc voltages having a frequency between approximately 400 Hz and 1000 Hz.

14. The printing system of claim 1, wherein the dc voltages are pulsed between approximately 0 V and 1000 V, and wherein the first and second imaging assemblies use pulses having generally opposite voltages from each other.

15. The printing system of claim 1, wherein the first imaging assembly includes a first split intermediate transfer member, and wherein the second imaging assembly includes a second split intermediate transfer member.

16. The printing system of claim 1, comprising imaging with negative and positive toners.

17. The printing system of claim 1, wherein the first imaging assembly includes a first non-split intermediate transfer member, and wherein the second imaging assembly includes a second non-split intermediate transfer member.

18. A duplex printing system comprising:

a first imaging member and a first intermediate transfer member for printing on a first side of a receiver material;

a second imaging member and a second intermediate transfer member for printing on a second side of the receiver material;

wherein the first and second intermediate transfer members form a single toning nip used to print on the first and second sides of the receiver material during a single pass of the receiver material through the system; and wherein the first and second intermediate transfer members use pulsed dc voltages to print on the first and second sides of the receiver material and wherein the first imaging assembly uses toner having an opposite polarity from toner used by the second imaging assembly.

19. The system of claim 18, wherein the first and second imaging members are photoconductors that use electrophotographic processes to print on the receiver material.

20. The system of claim 18, wherein the first and second imaging members are dielectric mediums that use direct electrostatic processes to print on the receiver material.

21. The system of claim 18, wherein the first and second intermediate transfer members are split rollers.

22. The system of claim 18, wherein the first and second intermediate transfer members are at least 2-up rollers.

23. The system of claim 18, wherein the pulsed dc voltages create an electric field between the first and second intermediate transfer members.

24. The system of claim 23, wherein the electric field alternates direction between the first and second intermediate transfer member at a frequency of the pulsed dc voltages.

25. The system of claim 23, wherein the electric field directs charged particles onto the receiver material.

26. The system of claim 25, wherein the charged particles are ions or toner.

27. An imaging system comprising:

a first imaging member and a first intermediate transfer for imaging on a first side of a receiver material;

a second imaging member and a second intermediate transfer member for imaging on a second side of the receiver material;

wherein the first and second intermediate transfer members rotate with substantially the same angular velocity so as to synchronously transfer images to the receiver material; and wherein the first and second intermediate transfer members use pulsed dc voltages to alternate a direction of an electric field between, and wherein the electric field is used to direct charged particles onto the first and second sides of the receiver material and wherein the first imaging assembly uses toner having an opposite polarity from toner used by the second imaging assembly.

28. The imaging system of claim 27, wherein the first and second imaging members are photoconductors that use charged area development or discharged area development modes.

29. The imaging system of claim 27, wherein the imaging system uses directed aerosol toner development to write a latent image or a real image onto the receiver material.

30. The imaging system of claim 27, wherein the charged particles are ions, dry toner, or liquid toner.

31. The imaging system of claim 27, wherein the pulsed dc voltages of the first intermediate transfer member have a frequency of between approximately 400 Hz and 1000 Hz.

* * * * *